US005359732A

United States Patent [19]

Waldman et al.

[11] Patent Number: 5,359,732

[45] Date of Patent: Nov. 1, 1994

[54] SWIMSUIT HAVING CONTROL HOLDING POWER INTEGRAL IN BODY FABRIC LAYER

[76] Inventors: Herman B. Waldman, 900 Fairfield, Easton, Pa. 18042; Mark S. Waldman, 266 Sidney School Rd., Annandale, N.J. 08801

[21] Appl. No.: 731,552

[22] Filed: Jul. 17, 1991

[51] Int. Cl.[5] ..... A41D 5/00

[52] U.S. Cl. ..... 2/67; 2/406; 2/402; 2/243.1

[58] Field of Search ..... 2/67, 402, 406, 243 A, 2/243 R, 243.1; 450/11, 15, 30, 31, 33; 66/170, 171, 169 R, 192, 193, 175, 176, 177

[56] References Cited

U.S. PATENT DOCUMENTS

| | | | |
|---|---|---|---|
| 2,103,133 | 12/1937 | Adamson . | |
| 2,120,665 | 6/1938 | Crimmins . | |
| 2,491,360 | 12/1949 | Brown | 2/67 |
| 2,550,327 | 4/1951 | Christensen | 2/67 |
| 2,963,022 | 12/1960 | Spetalnik | 450/15 |
| 3,077,758 | 2/1963 | Siciliano | 66/192 |
| 3,134,994 | 6/1964 | Christofferson | 2/67 |
| 4,103,485 | 8/1978 | Brües | 66/192 |
| 4,189,931 | 2/1980 | Groshens | 66/193 |
| 4,538,615 | 9/1985 | Pundyk . | |
| 4,583,544 | 4/1986 | Flanagan et al. | 2/67 |
| 4,956,878 | 9/1990 | Boynton | 2/67 |

FOREIGN PATENT DOCUMENTS 1460016 12/1976 United Kingdom .

OTHER PUBLICATIONS

Knitting Encyclopedia, Published by National Knitted Outerwear Association, pp. 232–233 (1972).

*Primary Examiner*—Clifford D. Crowder
*Assistant Examiner*—Gloria Hale
*Attorney, Agent, or Firm*—Seidel, Gonda, Lavorgna & Monaco

[57] ABSTRACT

A swimsuit is provided having the holding power of a typical figure control swimsuit using a single panel construction. The fabric of the swimsuit includes a substantially uniform stretch in both the longitudinal and horizontal directions. The fabric is cut to include a high modulus in the horizontal direction of the suit, as compared to the vertical direction, so as to provide improved retention and camouflage of body parts.

27 Claims, 1 Drawing Sheet

SWIMSUIT HAVING CONTROL HOLDING POWER INTEGRAL IN BODY FABRIC LAYER

FIELD OF THE INVENTION

The present invention relates to swimsuits and specifically to women's swimsuits. The present invention further relates to a swimsuit which utilizes the properties of a fabric to provide figure control and a comfortable fit.

BACKGROUND OF THE INVENTION

The evolution of the swimsuit has extended from the use of woven, rigid fabrics cut in dressmaker-type styles to the almost universal use of fabrics having some type of stretch or elasticity. There are several different types of stretch fabrics being used by the swimwear industry today. These fabrics generally fall into the following classifications: a nylon/spandex combination in a tricot-type knit, a nylon/spandex combination in a raschel-type knit, a cotton/spandex combination, and a polyester/spandex combination. Each of these combinations and knits has specific applications and specific characteristics.

The nylon/spandex combination in a tricot construction generally includes 80% nylon and 20% spandex, usually LYCRA (a registered trademark of DuPont Corporation). This fabric is commonly used for its four-way stretchability, i.e. the ability to stretch in both the length and width directions of the fabric. The advantage of this type stretch is that it permits the garment to fit different shapes and sizes without substantial modification to the pattern of the garment.

The nylon/spandex combination in a raschel-type construction is characterized by a combination of 85% nylon and 15% spandex. The stretch is typically significantly greater in one direction than the stretch in the other. Raschel-type knitting provides a lighter weight and less costly fabric, as compared to the tricot type construction.

The cotton/lycra combination generally includes 90% cotton and 10% spandex. Also included within this classification is a poly/cotton/spandex mix made of 45% polyester, 45% cotton and 10% spandex. These type fabrics are often used for exercise wear, such as leotards and the like. The cotton is used for perspiration absorption. Also, the cotton within the blend provides a softer feel to the fabric.

The polyester/spandex combination is a lightweight and less expensive alternative to the nylon/spandex or cotton/spandex combinations. This fabric material is primarily used in the United States in children's swimwear.

There are many variations and blends of spandex for use in swimwear or the like. Spandex is generally defined as a synthetic elastomeric fiber having a very high elasticity to break point (up to approximately 500% to 600%) and a high recovery from stretching. Though the chemistry is very complex, basically spandex is a series of elastomeric products including hard and soft segments and cross linking between the same. The fibers produced are generally white, dyeable and are stronger and lighter than rubber. The properties of spandex include high stretch, low set (the ability to spring back to its original shape concluded after repeated stretching), high durability, easiness of cleaning, uniformity, versatility, and dyeability.

Women's swimsuits can be generally classified into two broad categories. The first category is the standard swimsuit which is typically made from either of the nylon/spandex knits discussed above. The second category is contemplated for figure control and typically includes an inner lining that is used to contain parts of the body and to provide camouflage. The outer shell of the figure control swimsuit may also be made of the nylon/spandex blend. Most of these swimsuits use an inner lining, either only in the front or in the front and back. The lining restricts the body parts while the outer shell provides the camouflage.

BRIEF DESCRIPTION OF THE INVENTION

The present invention relates to a swimsuit, typically a woman's swimsuit, having figure control capabilities. The swimsuit is made using spandex material. The swimsuit material is capable of a substantial degree of stretch in both the length and width directions of the fabric. In addition, the fabric is cut such that the modulus or holding power is substantially greater in the horizontal direction in the swimsuit as compared to the vertical direction along the torso of the swimsuit wearer. Thus, the swimsuit of the present invention provides a high degree of stretchability so that it is comfortable to wear, while also providing a greater pull back across the body to create a smoothing effect.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
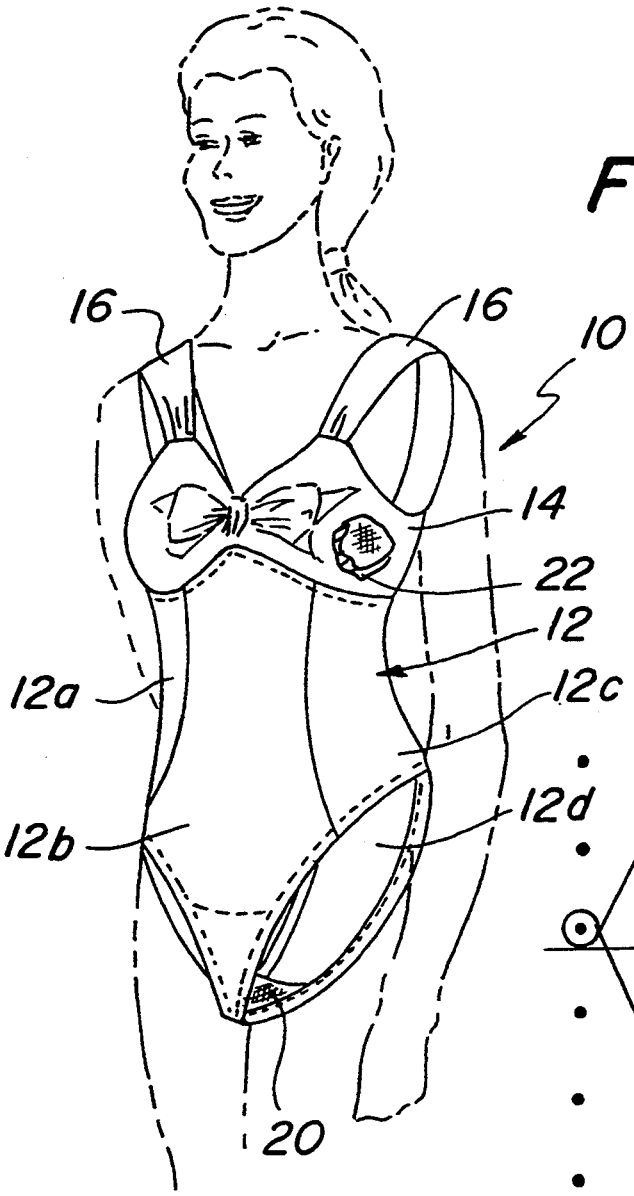
FIG. 1 shows a swimsuit in accordance with the present invention.

In the drawings where like numerals indicate like elements, there is illustrated a swimsuit which is generally designated by the numeral 10. The swimsuit 10 of the present invention is contemplated to be made in any number of styles, configurations and color patterns. In FIG. 1, the swimsuit 10 is shown for purposes of illustration only and is not restrictive on the patterns for which the invention may be constructed.

The swimsuit 10 includes a torso portion 12 and a bra portion 14. The torso portion 12 may include any number of panels. In the swimsuit 10 shown in FIG. 1, the front portion of the torso 12 includes three panels, 12A, 12B and 12C each joined to one another along a seam. The front panel may be formed by a single panel or any number of panels, as desired. A back panel 12D is attached on opposite sides to the front panels so as to form a garment that wraps completely around the body of the wearer. The back panel 12D may also be divided into separate portions, if desired. As illustrated, the center front panel 12B is attached to the back panel 12D by a crotch panel 20 so as to define leg openings in the swimsuit 10. The torso portion 12 is attached to the bra portion 14 underneath the bust area of the wearer. Provided above the bra portion 14 are shoulder straps 16. These shoulder straps are optional and may be incorporated as desired. Also, the bra portion 14 and the front of the torso portion 12 may be formed by a single piece of fabric. The shoulder straps 16 may also be formed with the bra portion and/or the torso portion, as desired.

As illustrated the bra portion 14 is provided with an inner lining 22. A lining is also provided in the crotch panel 20 of the swimsuit 10. The linings are considered known in the art. Other bra elements may also be included as desired, such as conventional cups.

The present invention generally contemplates an improved swimsuit comprised of a fabric material having specified properties. This fabric may encompass only a portion of the torso portion 12 or may comprise the entire swimsuit 10. The swimsuit 10 is characterized as having a generally square stretch, in that the material is capable of expanding in equal amounts in both the length and width directions of the fabric. This square stretch is characterized by a high degree of elasticity which is provided for purposes of comfort of the wearer. The fabric within the present invention is further contemplated to include a substantially greater modulus (pounds of holding power) in one direction of the fabric. In making the swimsuit, the fabric is cut so that this greater modulus lies in the horizontal direction of the swimsuit, i.e., across the wearer's body (as compared to the vertical direction between the bust and the crotch). This higher modulus across the body of the wearer provides figure control in that it restricts the body parts while also providing the necessary camouflage.

In the swimsuit of the present invention, there is a relationship between the stretch and modulus characteristics that produce a "wearing stretch" as seen by the swimsuit wearer. The modulus affects the "wearing stretch" function of the suit in that the higher the modulus the more resistant the fabric material will be to linear stretch. If the modulus is too high, the suit will not be comfortable or properly fit a range of body sizes. Also, the higher modulus within the fabric of the swimsuit, positioned in the horizontal direction of the suit combined with the stretch characteristics in that same direction, distinguishes the invention over the prior art. This combination of modulus and stretch combine to provide a holding power as well as a comfortable "wearing stretch." Moreover, the qualities of the present invention are contemplated to be provided without the use of an inner control lining.

Figure 2:
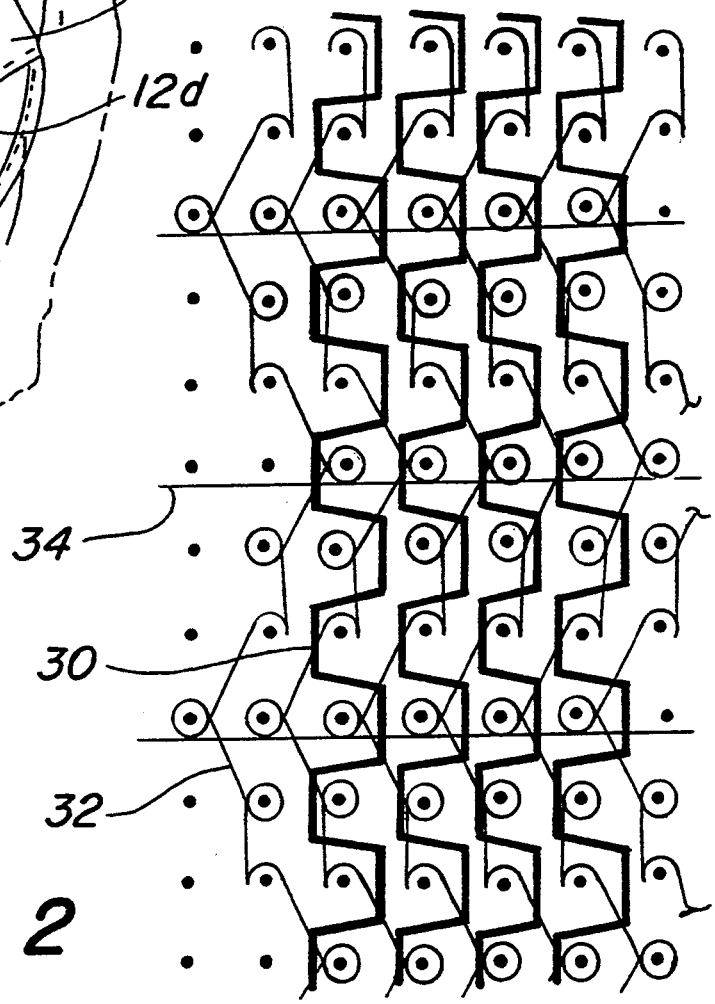
FIG. 2 shows a pattern for a fabric material contemplated by the present invention.

The preferred fabric used in the swimsuit of the present invention is generally illustrated in FIG. 2. This fabric is produced by a warp knitting method called "weft-lock" or "weft-insertion". This weft-insertion method may be performed by machines manufactured by the Mayer company of West Germany. Weft-insertion generally includes the insertion of the ends of spandex threads across the width of the fabric during the knitting process (i.e., as picks are inserted on a weaving loom). This enables the fabric to obtain stretchability in both directions of the fabric and to control the modulus or holding power of the fabric in both directions. In the weft-insertion method, the knitting action is combined with a woven inlay or insert to provide a snap-back or return. Thus, the advantages of both a knitted and a woven type fabric are achieved.

The fabric shown in FIG. 2 includes a back bar 30 made of spandex, a front bar 32 of nylon, and inserts 34 made of spandex. The combination of the spandex back bar 30 and inserts 34 provides the stretch in both directions of the fabric. Preferably, the threads of the fabric are chosen such that the stretch is square, i.e., substantially equivalent in both the length and width directions of the fabric. (In FIG. 2, the length direction of the fabric lies along the direction of the back bar 30 and front bar 32 and the width direction of the fabric is defined by the direction of the inserts 34.)

One fabric for use with the present invention generally includes a combination of 69% nylon and 31% spandex having a weight of approximately 8.43 ounces per square yard. The fabric is further defined by 61±2 ends per inch and 55±2 courses/inch. This fabric includes a back bar of 280 denier LYCRA, a front bar of 50 denier nylon, and inserts of 140 denier LYCRA in the width direction of the fabric (i.e., across the fabric from selvage to selvage). Because of the lower denier in the width direction of the fabric and the formation of the weft insertion pattern, the fabric is capable of stretching more easily in that direction. At the fit point (typically defined as a 30% stretch of the fabric), the swimsuit of the present invention is cut to have more than double the holding power in the horizontal direction of the swimsuit than the holding power of an unlined swimsuit made from a typical raschel fabric and more than two times the stretch in the longitudinal direction of the swimsuit.

The fabric for the swimsuit of the present invention can be defined by applying a stretching test. Specifically, a stretching test using the fabrics and tensile cartridge of a Zwick Microprocessor DYP type machine can be used to determine the constant rate of extension (CRE) of the fabric at a specific load. The following chart shows the results of a CRE comparison loop method test performed on the Zwick machine using a 3"×5" loop and a 20 pound effective load. The data for the fabric of the present invention is compared to two standard swimsuit fabrics using the same testing procedure.

Fabric Used in the Swimsuit of Present Invention (weight—238.8 lbs.; fabric yield—0.95 yards/pound; 54 holes/inch in the length direction of the fabric; wale—63 in the length direction of the fabric; and uncut fabric width—75.5 inches)

| Stretch (% of ultimate elongation) | | | | Modulus (Lbs pressure at elongation) | | | |
|---|---|---|---|---|---|---|---|
| Length | | Width | | Length | | Width | |
| 1st Flex | 3rd Flex | 1st Flex | 3rd Flex | 1st Flex | 3rd Flex | 1st Flex | 3rd Flex |
| 148 | 158 | 157 | 164 | 2.02 | 1.21 | 1.19 | .64 |

Tricot (82% Nylon/18% LYCRA Spandex)

(weight—123.7 lbs,; fabric yield—1.84 yards/pound; 106 holes/inch in the length direction of the fabric; wale—62 in the length direction of the fabric; and uncut fabric width—62.5 inches)

| Stretch | | | | Modulus | | | |
|---|---|---|---|---|---|---|---|
| Length | | Width | | Length | | Width | |
| 1st | 3rd | 1st | 3rd | 1st | 3rd | 1st | 3rd |
| Flex | Flex | Flex | Flex | Flex | Flex | Flex | Flex |
| 212 | 220 | 124 | 129 | 1.04 | .50 | .42 | .19 |

Raschel (85% Nylon/15% LYCRA Spandex)

(weight—133.4 lbs,; fabric yield—1.70 yards/pound; 56 holes/inch in the length direction of the fabric; wale—43 in the length direction of the fabric; and uncut fabric width—62.5 inches)

| Stretch | | | | Modulus | | | |
|---|---|---|---|---|---|---|---|
| Length | | Width | | Length | | Width | |
| 1st | 3rd | 1st | 3rd | 1st | 3rd | 1st | 3rd |
| Flex | Flex | Flex | Flex | Flex | Flex | Flex | Flex |
| 216 | 227 | 50 | 54 | .90 | .39 | 3.90 | 2.12 |

Each of the above readings for the modulus were taken at a thirty percent (30%) stretch point. This stretch point is considered to be a normal fit position for a swimsuit. Also, each of the test samples were made in the same color (black) as a control. Other conditions such as temperature and humidity, were maintained constant during the test.

As can be seen in the above noted data, a typical spandex tricot-type fabric includes substantial flexibility in the neighborhood of 200% in the length direction of the fabric but is relatively less in the width direction, being approximately 120%. Also the ability of the material to hold as defined by the modulus is limited. In the spandex raschel-type fabric, flexibility is provided in the length direction of the fabric. However, the stretch in the width direction of the fabric is substantially limited. The modulus in the width direction of the fabric is extremely high as compared to the modulus in the length direction of the fabric (or as compared to the modulus numbers for the tricot fabric). Due to the limited amount of stretch in the width direction of the fabric, the ability of the fabric to give and provide sufficient comfort and fit (i.e., wearing stretch) within the range parameters of the present invention is substantially limited.

The test data shows that the fabric preferably contemplated for use in the swimsuit of the present invention provides a stretch of approximately 150% in both the length and the width directions of the fabric. This stretch is substantially square and, thus, will give evenly. However, the modulus in the length direction of the fabric is greater than that in the width direction of the fabric, i.e. 2.02 to 1.19 pounds of holding power. Thus, the ability to hold in the length direction of the fabric is substantially greater. This holding ability flattens and camouflages body portions. Thus, the swimsuit has the ability to retain the body portions rather than by the use of a separate inner lining.

The test results for the length and width parameters of the fabric samples in the above results correspond to a specific direction within the test fabric. In the swimsuit of the present invention the fabric would be cut such that the width direction of the fabric corresponds to the vertical direction within the swimsuit of the invention. Thus, the swimsuit provides a higher modulus in the horizontal direction of the suit or across the body of the swimsuit wearer. This attribute for the swimsuit of the present invention is generally opposite of that presently found in the art. Typically, a swimsuit manufacturer would desire to relax the holding power in the horizontal direction of the swimsuit so that the suit may accommodate any number of body shapes within a specific size range. However, in the present invention, the greater modulus is in the horizontal direction so as to provide substantial holding power to flatten and smooth the body, eliminating or reducing wrinkles and bulges. The ability to stretch in the vertical direction also provides greater comfort in fit and permits the wearer to bend without substantial displacement of the swimsuit. These features of the present invention are not contemplated or possible with the standard swimsuit fabrics.

A fabric in accordance with the swimsuit of the present invention .is contemplated to stretch in the range of 100% to in excess of 250% of its original length and width. (As measured by the Zwick machine in accordance with the above noted procedure and using the first flex reading.) It is also contemplated that the greater modulus of the fabric in the one direction of the fabric and positioned in the horizontal direction of the swimsuit will be in the range of 1.4 to 3.0 pounds of holding power. The modulus in the second direction of the fabric positioned along the vertical direction of the swimsuit is contemplated to fall within the range of approximately 0.9 to 1.5 pounds of holding power. (Again, these ranges are a measurement on the Zwick machine using the first flex reading.) These parameters for the fabric within the swimsuit of the present invention are contemplated to provide the desired "wearing stretch" in both the horizontal and the vertical direction, for purposes of comfort and fit, and the desired holding power in the horizontal direction of the swimsuit as a result of the fabric alone.

It should be emphasized that the swimsuit of the present invention provides its holding power without the use of an inner lining. Thus, the figure control and camouflage provided by the swimsuit are created by the use of the fabric properties alone. However, certain variations of the construction of the suit are contemplated. This would include the use of different materials for the bra portion 14 which may or may not include a lining. Also, the contemplated fabric material may be included in only certain portions of the swimsuit, such as in the front panels 12A, 12B, and 12C and not in the back panel 12D, or only in one of the front panels 12A, 12B, 12C of torso portion 12, such as panel 12B. Furthermore, the contemplated fabric material may be utilized within a two piece swimsuit without departing from the essence of the present invention.

The present invention may be embodied in other specific forms, such as exercise wear and the like which are similar to a swimsuit, without departing from the spirit or essential attributes thereof, and accordingly, reference should be made to the appended claims, rather than to the foregoing specification, as indicating the scope of the invention.

We claim:

1. A swimsuit comprising: a front panel, a back panel, the front panel and back panel forming a torso portion to be worn on the torso of the body and forming a crotch panel with leg openings on opposite sides thereof, and a bra portion to be worn over the bust area of the body, the bra portion attached to the torso portion, at least the front or back panel of the torso portion made of a fabric capable of stretching in both the vertical and horizontal directions of the swimsuit, the modulus of the fabric of the torso portion in the horizontal direction of the swimsuit being in the range of 1.4 to 3.0 pounds of holding power and the modulus of the fabric in the vertical direction of the swimsuit being in the range of 0.9 to 1.5 pounds of holding power, the fabric of the front or back panel permitting the torso portion of the swimsuit to stretch in both the vertical and horizontal directions and providing figure control horizontally across the body.

2. A swimsuit as claimed in claim 1 wherein the portion of the front or back panel has a substantially equivalent stretch in the horizontal and vertical direction of the swimsuit.

3. A swimsuit as claimed in claim 2 wherein the stretch of the portion of the front or back panel is in the range of 100% to 250%.

4. A swimsuit as claimed in claim 3 wherein the 1 portion of the front or back panel is made from a weft insertion type knit.

5. A swimsuit as claimed in claim 1 wherein the fabric includes a stretch of approximately 150%, a modulus in the horizontal direction of the swimsuit of approximately 2.0 pounds of holding power, and a modulus in the vertical direction of the swimsuit of approximately 1.2 pounds of holding power.

6. A swimsuit as claimed in claim 5 wherein the portion of the front or back panel is made from a weft insertion type knit.

7. A woman's swimsuit comprising: a front panel, a back panel, the front panel and back panel attached to one another to form a torso portion to be worn on the torso of the woman's body, the connection of the front panel to the back panel also forming leg openings in the lower end of the torso portion, and a bra portion attached to the torso portion, the bra portion to be worn over the breast area of the woman's body, the fabric of the torso portion having substantially equivalent stretch in both directions and having a modulus in a horizontal direction across the torso portion that is greater than the modulus of the fabric between the bra portion and the leg openings, the fabric of the torso portion of the swimsuit to stretch in both the vertical and horizontal directions and providing figure control horizontally across the body.

8. A swimsuit as claimed in claim 7 wherein the modulus in the horizontal direction of the swimsuit is in the range of 1.4 to 3.0 pounds of holding power.

9. A swimsuit as claimed in claim 8 wherein the modulus in the vertical direction of the swimsuit is in the range of 0.9 to 1.5 pounds of holding power.

10. A swimsuit as claimed in claim 9 wherein the swimsuit has a substantially equivalent stretch in the horizontal and vertical directions of the swimsuit.

11. A swimsuit as claimed in claim 10 wherein the stretch of the swimsuit is in the range of 100% to 250%.

12. A swimsuit as claimed in claim 11 wherein the swimsuit is made from a weft insertion type knit.

13. A swimsuit as claimed in claim 7 wherein the swimsuit includes a stretch of approximately 150%, a modulus in the horizontal direction of approximately 2.0 pounds of holding power, and a modulus in the vertical direction of approximately 1.2 pounds of holding power.

14. A swimsuit as claimed in claim 13 wherein the swimsuit is made from a weft insertion type knit.

15. A swimsuit as claimed in claim 7 wherein the weft insertion knit includes a front bar of 50 denier nylon, a back bar of 280 denier spandex and inserts in the width direction of 140 denier spandex.

16. The swimsuit as claimed in claim 7 wherein the back panel of the torso portion is made of the same type fabric as the front panel of the torso portion and is oriented to provide the greater modulus in the same direction as the front panel.

17. The swimsuit as claimed in claim 7, wherein the bra portion is separately formed from the front panel, the bra portion including shoulder straps that connect at one end to the back panel.

18. The swimsuit as claimed in claim 7, wherein the bra portion is separately formed from the front panel and the bra portion includes an inner lining.

19. The swimsuit as claimed in claim 7 wherein the front panel includes a stretch in excess of 150% in both directions.

20. The swimsuit as claimed in claim 7, wherein the modulus across the front panel is in excess of 2.0 pounds of holding power at a thirty percent (30%) stretch.

21. The swimsuit as claimed in claim 7, wherein the front panel is made by a weft-insertion method.

22. The swimsuit as claimed in claim 7, wherein the front panel is made of a combination of spandex and nylon.

23. The swimsuit as claimed in claim 7, wherein the front panel includes a stretch that is substantially equivalent and in excess of 150% in both directions, the modulus across the front panel is in excess of 2.0 pounds of holding power at thirty percent (30%) stretch, and the front panel is made by a weft insertion method using a combination of spandex and nylon.

24. A women's swimsuit comprising: a torso portion to be worn over at least a portion of the torso of the body, the torso portion defining two opposing leg openings positioned on opposite sides of a crotch panel, the torso portion being made of a substantially unlined layer of fabric capable of stretching in both the vertical and horizontal directions of the body substantially in the range of 100% to 250% and having a modulus in a horizontal direction across the body in the range of 1.4 to 3.0 pounds of holding power and the modulus vertically along the body in the range of 0.9 to 1.5 pounds of holding power, the crotch panel of the torso portion having a lining, and a bra portion to be worn over at least a portion of the bust area of the body, the bra portion attached to the torso portion at a position under the bust, the bra portion being separate from and attached to the torso portion, the bra portion including a lining the fabric of the torso portion permitting the swimsuit to stretch in both the vertical and horizontal directions when worn on a body and providing figure control horizontally across the body.

25. A swimsuit as claimed in claim 24 wherein the fabric includes a stretch of approximately 150%, a modulus in the horizontal direction of the swimsuit of approximately 2.0 pounds of holding power, and a modulus in the vertical direction of the swimsuit of approximately 1.2 pounds of holding power.

26. A swimsuit as claimed in claim 25 wherein the fabric of the torso portion is made from a weft insertion type knit.

27. A women's swimsuit comprising a torso portion to be worn over at least a portion of the torso of the body, the torso portion defining two opposing leg openings positioned on opposite sides of a crotch panel, and a bra portion to be worn over at least a portion of the bust area of the body, the torso portion being made of a substantially unlined layer of fabric having substantially equivalent stretch in both the vertical and horizontal directions of the body and having a modulus in a horizontal direction across the body that is greater than the modulus vertically along the body, the fabric of the torso portion permitting the swimsuit to stretch in both the vertical and horizontal directions when worn and providing figure control horizontally across the body.

* * * * *